US006216297B1

(12) United States Patent
Lemke

(10) Patent No.: US 6,216,297 B1
(45) Date of Patent: Apr. 17, 2001

(54) PAK-A-PILLOW

(76) Inventor: Alicia Lemke, 3682 Lake Mendota Dr., Madison, WI (US) 53705

( * ) Notice: Subject to any disclaimer, the term of this patent is extended or adjusted under 35 U.S.C. 154(b) by 0 days.

(21) Appl. No.: 09/035,321

(22) Filed: Mar. 5, 1998

(51) Int. Cl.[7] ..... A47C 20/02
(52) U.S. Cl. ..... 5/636; 5/639
(58) Field of Search ..... 5/636, 640, 490, 5/491, 639, 645; 150/104, 107, 110, 113, 129, 127; 303/109; 190/124, 125

(56) References Cited

U.S. PATENT DOCUMENTS 1,686,247 * 10/1928 Murphy ..... 5/639
2,591,379 * 4/1952 Schradermeier ..... 150/35
3,148,389 * 9/1964 Lustig ..... 5/636
3,863,283 * 2/1975 Mohr ..... 5/645 X
4,116,310 * 9/1978 Shields .
4,222,468 * 9/1980 De Fries .
4,263,951 * 4/1981 Siegel ..... 150/35
4,277,859 * 7/1981 Seaman ..... 5/639
4,688,286 * 8/1987 Miker, Jr. .
4,768,245 * 9/1988 Dutton .
4,889,512 * 12/1989 Burnett et al. ..... 5/636
5,115,528 * 5/1992 Lamle ..... 5/640
5,118,316 * 6/1992 Lorizio ..... 5/639

* cited by examiner

*Primary Examiner*—Lynne H. Browne
*Assistant Examiner*—Fredrick Conley

(57) ABSTRACT

A travel pillow having an interior storage pocket for carrying pajamas and other overnight articles comprises an outer casement encompassing an inner compartment. There is an opening in the casement that provides an entrance to a pocket. Attached at the entrance of the casement and extending into the inner compartment are pocket lining walls. These walls are joined to the casement at the entrance of the pocket and at the perimeter of the sides and bottom of the pocket linings to form the pocket extending into the inner compartment. Surrounding the pocket on either side and generally filling the inter compartment is padding material as conventionally used in a pillow. The pocket opening may contain closure means such as a zipper or snaps to secure the pocket in a closed position when being carried. Handles or strap means may be located on the pillow to facilitate carrying. The travel pillow is particularly useful as both a pillow and carrying case for youngsters who attend slumber parties or sleep overs and need convenient means for carrying overnight articles.

19 Claims, 3 Drawing Sheets

Fig. 4
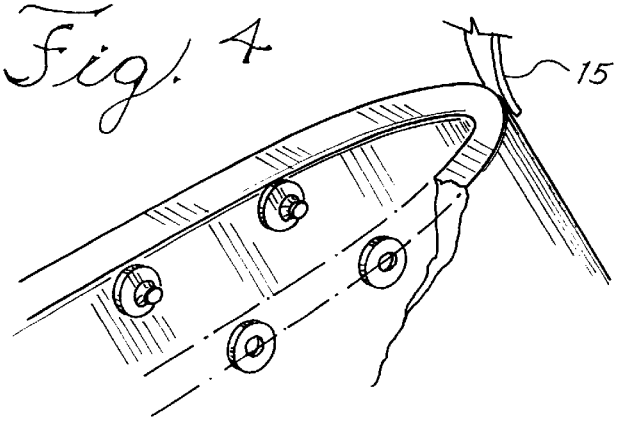
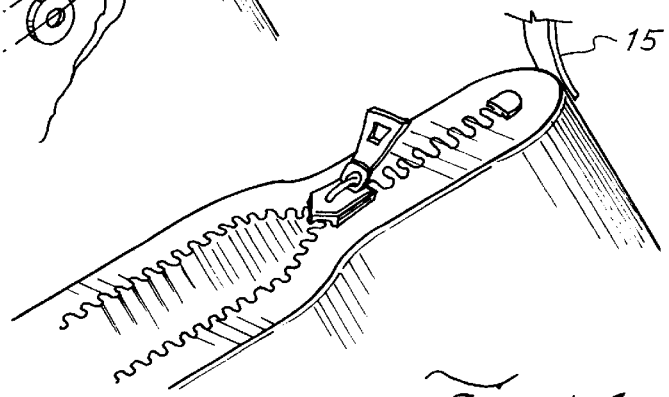
Fig. 5
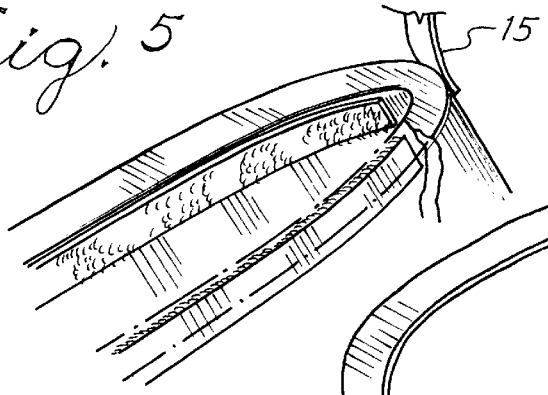
Fig. 6
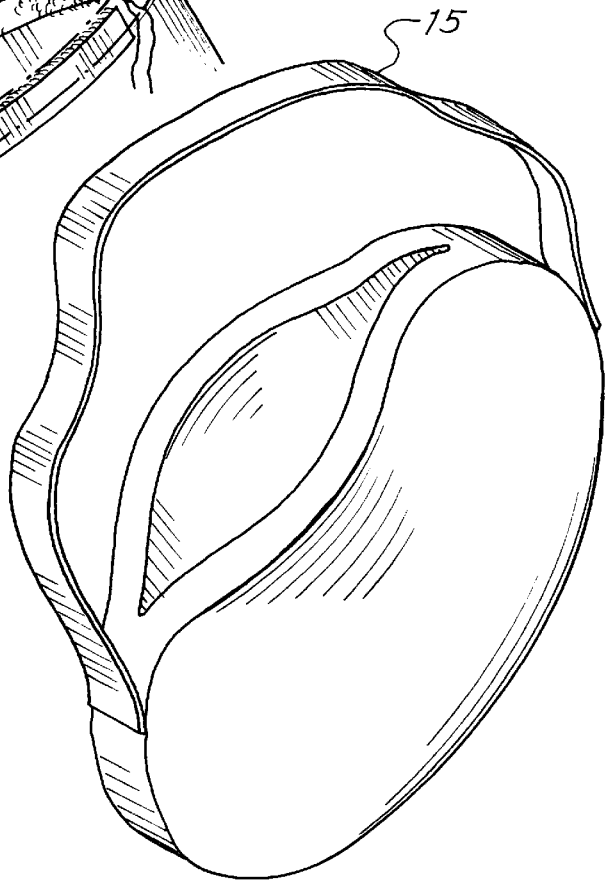
Fig. 7

PAK-A-PILLOW

TECHNICAL FIELD

The invention relates generally to pillows wherein the exterior boundaries of the pillow also generally define the perimeter of a main pocket located in the interior of the pillow. The pillow and pocket combination can be suitably sized to accommodate the needs of adults, adolescents, pets and children to store various items such as for example, toys, pet supplies, recreational items and clothing apparel suitable for overnight trips, recreational outings, sporting events, trips away from home for either long or short term or sleep overs. The combination pocket in a pillow can either, after the removal of the pocket contents, or while the contents are still stored therein be used as a pillow, so as to preclude the necessity of having a pillow in addition to a carrying case for the items required for the trip or sleep over. This pocket in a pillow is for use as a travel bag, having a design providing improved durability, strength and comfort and to be carried or otherwise transported. Additionally, the pocket in a pillow may further include a blanket of suitable size to fit neatly within the interior pocket. The inclusion of this blanket further adds to the comfort and thickness of the pillow, and the protective utility of the padding between the outer casement and the inner lining.

BACKGROUND OF THE INVENTION

Several forms of pillows with pockets or storage compartments are known in the art U.S. Pat. No. 4,389,784 to Cohen is directed to a pillow/display case for displaying various small objects. The pillow/display case in Cohen has a transparent, flexible overlay sheet secured to a wall of the pillow, creating a display pocket for the objects. U.S. Pat. No. 4,091,481 to Redman discloses a tooth-shaped pillow with a pocket for holding money and baby teeth. U.S. Pat. No. 3,863,283 to More shows a cushion with an exterior pouch for storing first-aid material particularly for carrying in an automobile. U.S. Pat. No. 2,962,731 to Bounds discloses a pillow with an interior pocket for carrying a radio, a handkerchief, or other valuable articles such that these articles are hidden. The prior art also includes pillow combinations which combine a pillow with some other article. U.S. Pat. No. 4,227,270 to.

Rivera is directed to a pillow with a baby bottle holder. British Patent 93,649 to Birch discloses a water bottle in a pillow. Furthermore, U.S. Pat. no. 4,768,245 to Dutton discloses a children's pillow with a book combination, including a conventional pillow with a pocket sewn to the exterior portion of the conventional pillow for receiving a book. The cover of the book contains some indicia, design, or color representing the contents or subject matter of the book and the identical or substantially similar indicia, designs, or color representations are likewise sewn into the cover of the pocket on the exterior of the pillow. U.S. Pat. No. 4,116,310 to Shields discloses a combined cushion and article carrier. This invention particularly provides a foam cushion held within a bag-like fabric covering, this fabric covering having a shoulder strap connected thereto to facilitate carrying of the bag. The foam cushion has an indentation formed in one surface for receiving articles such as closable cups or other bingo paraphernalia. U.S. Pat. No. 4,277,859 to Seaman discloses an inflatable traveling pillow, including an inner, rubber, inflatable portion and an intermediate fiber-filled case for the inflatable portion. The exterior cover is designed to prevent the head or other body part from contacting the plastic inflatable pillow portion. The carrying handle also provides a compartment for the storage of a small pneumatic pump to facilitate the inflation of the enclosed interior inflatable portion. The pillow's of the prior art disclose standard pillows with pouches and pockets superficially attached thereto whereby items may be protected and stored. Moreover the prior art teaches a pillow with additional cushioning supplied by inflatable or pneumatic cushion portions and/or where the pocket is superficially attached to the pillow where there is not sufficient padding between the layers of fabric which form the pocket, such that if items were stored within the pocket, and if the pillow were used, as a pillow, without removal of the items, the comfort of the user would be lessened as compared to the present invention. The prior art does not teach of a pillow to be transported by the use of a strap or handle, which is simultaneously a pocket for transporting and storing items, wherein the stored items are somewhat protected because of the padding which generally fills a compartment between the outer casement and the inner pocket lining.

The pillow of this invention solves these problems by means of a suitably sized pocket containing pillow which allows the individual to store items in the interior portion of the pillow, while still allowing for its use as a conventional pillow subsequent to, or coincident with, the articles being stored within the interior pillow pocket. The ability of the pillow of this invention to function as a pillow while simultaneously storing items is due, in part, to the inclusion of sufficient padding between the layers forming the exterior and interior lining portions. The pillow of this invention further comprises a handle, strap or other carrying means attached to the casement and different than the outer casement, to further facilitate use of the pillow as a transportable pillow and carrying bag.

SUMMARY OF THE INVENTION

Pursuant to the present invention, a pillow of conventional construction has an outer cover or casement of suitable material defining an interior space. As with a conventional pillow, the interior contains appropriate stuffing or padding held within the cover so it may, if desired, function as a pillow when empty and yet may simultaneous with the storage of items, also function as a suitably comfortable pillow. Unlike other designs, however, the present invention lacks a seam on one edge, thereby providing additional strength and durability and comfort to the pillow. The pillow can be of any desired configuration. However, for purposes of illustration it will be described in terms of a conventional pillow the perimeter of which is defined by opposing sides, an open edge and an edge lacking a seam, i.e. is generally rectangular in shape. Along one edge of the pillow is an opening that functions as an entrance to a pocket extending into the interior of the pillow.

In one preferred embodiment, the pocket is defined by means of opposing lining walls attached to the casement along either side of the opening at the pillow perimeter and attached to each other along opposing side edges. If desired, closure means may be located at the pocket entrance to secure the pocket in a closed position. In one preferred embodiment the closure means facilitates entrance into the pocket at any selected point of the entrance, while maintaining closed the remaining portions of the closure means. Still further, the closure means should be selected to provide optimum comfort, strength, durability and resistance to weather caused damage.

In another preferred embodiment, the pocket is as previously defined except were closure means may be along three sides of the pocket. In this embodiment, the pillow is only fixedly attached along one perimeter and is operably attached along the remaining perimeters. In this embodiment, the closure means could be opened, providing an elongated pillow. This type of opening can be visualized as the opening of a hanging file from a "V" configuration when each side perimeter is openable attached to the adjacent side but which can be opened up, pushing the two top edges away from each other, to lie flat on a surface, such as a desk or floor. In this embodiment, a pack a pillow according to this embodiment may open to provide a pillow of larger area, perhaps for use by a pet, more than one person or as a ground cover. Suitable closure means for accomplishing this embodiment are inter engaging snaps or perhaps hook and loop type systems such as a VELCRO system. The closure means should allow random access to the pocket through any point along the closure, without requiring that other sections be opened. This freedom and multiple pathway access to the pocket increases convenience and also provides an additional mode to practice this invention.

The pocket is situated in the pillow interior such that the stuffing or padding is positioned between the pocket walls and exterior cover on all sides of the pocket, i.e., the padding generally fills a compartment which is one continuous padding section, surrounding and defining the inner pocket. This arrangement is important to provide comfort, durability and provide a more pillow-like travel bag.

Moreover, where a handle, strap or other carrying means is attached to the pocket in a pillow, they should either be suitable pliable so as not to interfere with the comfort and/or with the desire to sleep and/or relax, and where desired, the carrying means may be removably adhered to an interior wall so they effectively hidden. This hiding of the handles or carrying means further provides the appearance of a standard pillow.

The dimensions of the pocket may be substantially the same as the perimeter of the pillow or smaller, i.e., the pocket may be of smaller dimension than the pillow. A pocket in a pillow which is smaller than the outer perimeter is important because it allows the pillow to have substantially more padding surrounding the pocket, providing even greater comfort when used as a pillow while contents are stored therein. The pillow is of appropriate size and shape to be used by a child, adolescent, animal or adult.

The closure means at the pocket entrance and/or along two adjacent additional sides may comprise snaps, fasteners, hooks and loops, e.g. Velcro (TM), or other similar closure means. The type of closure means used is important from two perspectives. If the pocket in a pillow is used by a child, the closure means should be of a type that is easily manipulated by the child, such as a Velcro type closure. Additionally, the closure means should provide for opening at the pocket entrance in random locations along the opening and/or at multiple positions along the opening. When this invention is used by the elderly the closure means should be easily manipulated, even if physical and/or mental abilities are limited.

The second concern relative to the closure means is that it not detract from the comfort provided by the pillow, regardless of whether the pocket is full or empty. Although still contemplated, a zipper is less desired because of the discomfort often associated therewith and potential damage caused by water. Additionally, the pillow can be equipped with handles or shoulder straps to facilitate the carrying of the pillow with the pocket in an upright position. To further the comfort of the pillow, the handle or shoulder straps can optionally be removed. This embodiment facilitates removal of straps or handles and placement in the pocket for later use.

BRIEF DESCRIPTION OF THE DRAWINGS

FIG. 4 is a perspective view of the pillow in a vertical or carrying position showing carrying means attached to the pillow at the opening of the pocket. Closure means such as snaps are shown attached to the inner walls of the pocket opening.

FIG. 5 is a perspective view of the pillow in a vertical or carrying position showing carrying means attached to the pillow at the opening of the pocket. Closure means such as VELCRO type hook and loop closures are shown attached to the inner walls of the pocket opening.

FIG. 6 is a perspective view of the pillow in a vertical or carrying position showing carrying means attached to the pillow at the opening of the pocket. Closure means such as a zipper are shown attached to the inner walls of the pocket opening.

FIG. 7 is a perspective view of an embodiment of the pillow in a vertical or carrying position wherein the pillow is of substantially round or circular shape. Carrying means is shown attached to the pillow near the opening to the pocket thereof.

DETAILED DESCRIPTION OF THE DRAWINGS

Figure 1:
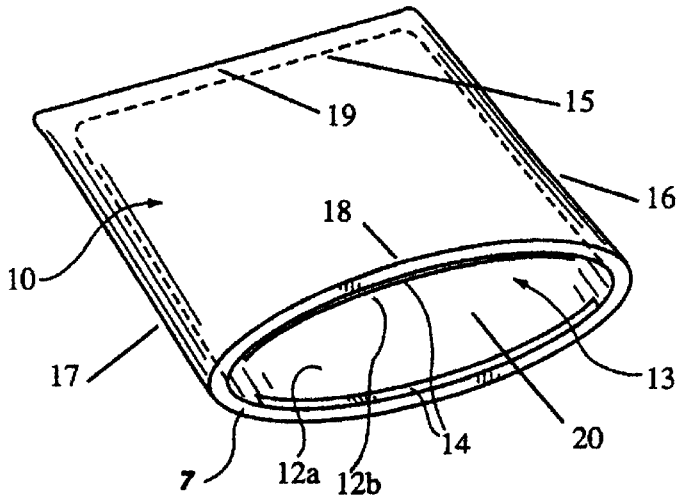
FIG. 1 is a perspective view of a pillow in a horizontal or resting position showing an interior pocket with the pocket entrance being in an open position.
Figure 2:
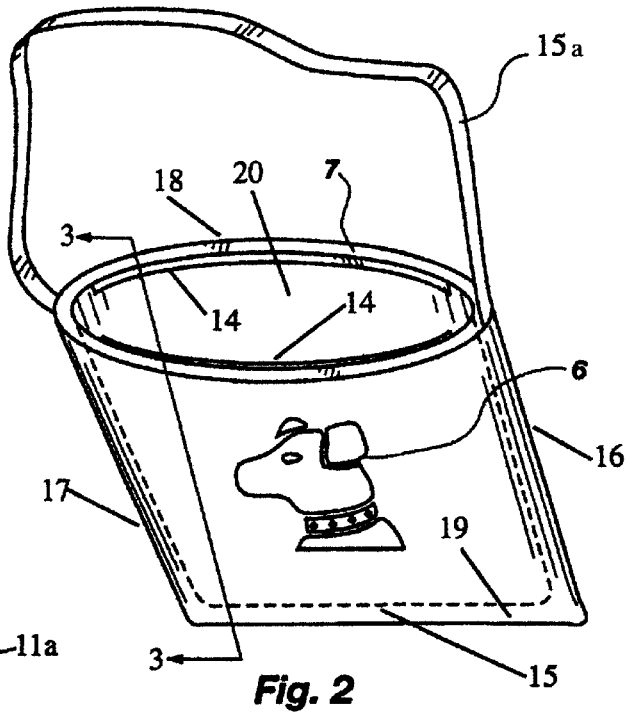
FIG. 2 is also a perspective view of a pillow in a vertical or carrying position showing an interior pocket with the pocket entrance being open and further showing carrying means attached to the pillow.
Figure 3:
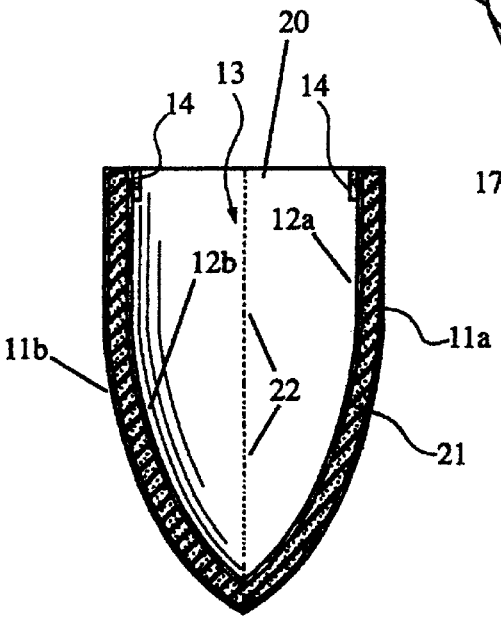
FIG. 3 is a cross sectional view taken along lines 3—3 of the pillow shown in FIG. 2.
Figure 8:
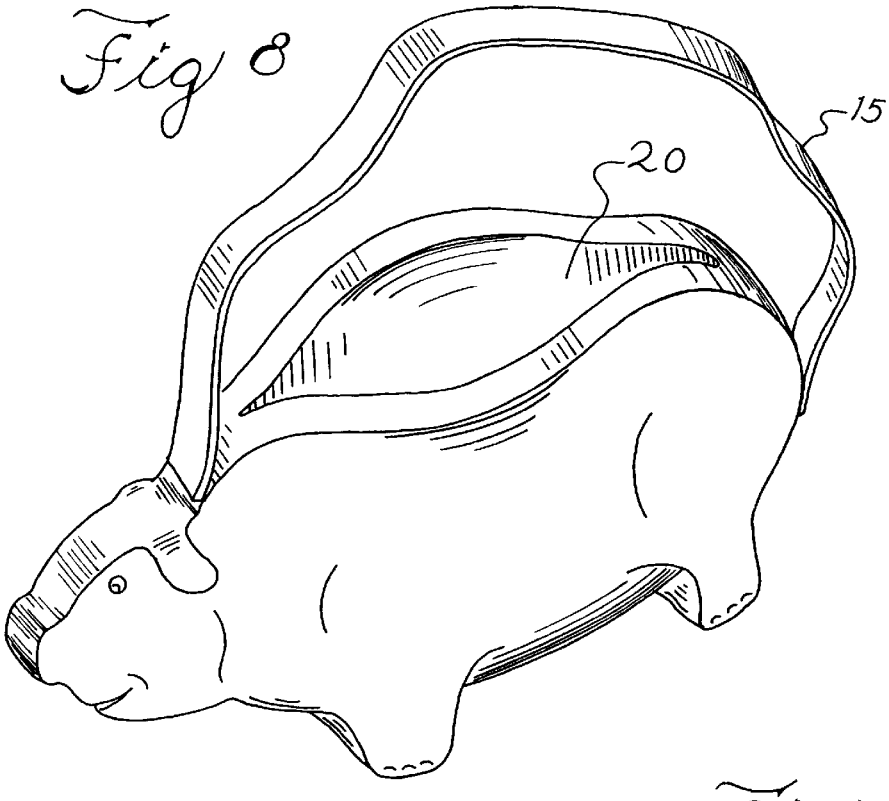
FIG. 8 is a perspective view of an embodiment of the pillow in a vertical or carrying position wherein the pillow is of substantially animal shape. Carrying means is shown attached to the pillow near the opening to the pocket thereof.
Figure 9:
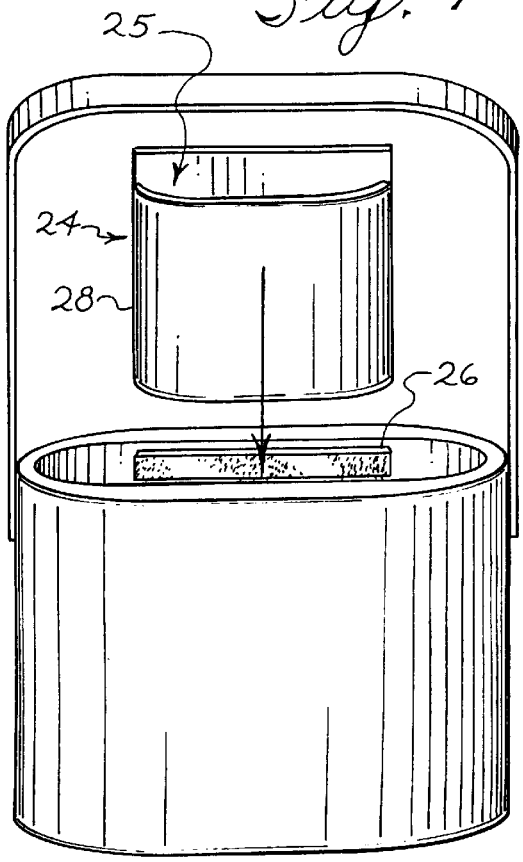
FIG. 9 is a perspective view of another embodiment of the pocket in a pillow invention in a vertical or carrying position wherein is shown the optional second inner pocket. An attachment means whereby the inner pocket is attached to the inner wall of the large, main pocket is shown.
Figure 10:
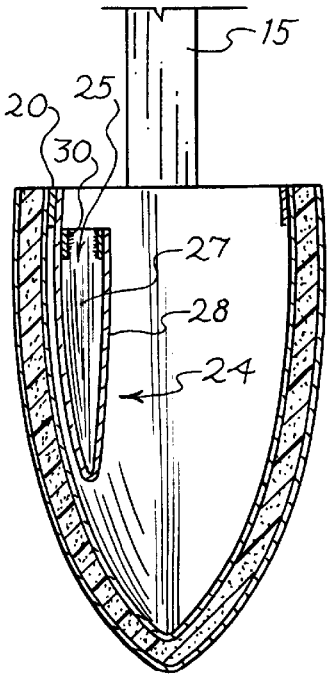
FIG. 10 is a cross sectional view taken along lines 3—3 of the pillow shown in FIG. 2 with the smaller second pocket removably attached to the inner wall of the larger first pocket by an attachment means. Closure means for the second smaller pocket is shown. Carrying means is also shown attached to the larger first pocket.

FIG. 1 is a perspective view of one embodiment showing a pillow 10 having an outer surface or casement 11 and an interior pocket 13 defined by adjoined facing pocket walls 12*a* and 12*b*. FIG. 2 shows a similar embodiment in an upright, or carrying position having carrying means, e.g., a carrying strap 15*a* attached thereto. The interior pocket 13, delineated by the pocket sidewalls 12*a* and 12*b* by an attachment means, 26 as in FIG. 9 and 10, is profiled by dotted line 15 in FIGS. 1 and 2 to be substantially rectangular. FIG. 3 is a cross section of the view shown in FIG. 2 showing the pocket 13, sidewalls 12*a* and 12*b*such as a VELCRO™ type closure means as shown 30 in FIG. 10, padding material generally filling the continuous padding compartment 21, and casement walls 11*a* and 11*b*. In each figure, the pocket 13 is wide open.

More specifically, the pillow 10 is made up of a single continuous outer casement or covering 11 having opposing sides 11*a* and 11*b*. The casement sides are bounded by a perimeter designated by side edges 16 and 17 and an unbound bottom edge 19 and an open top edge 18. The padding compartment 7 is enveloped by the casement wall 11 to the exterior and the inner pocket lining, 12. There is an opening 20 in the top edge of the casement perimeter that provides access into the pillow pocket 13. The pocket 13 is defined by opposing pocket walls 12*a* and 12*b* attached to the casement wall 11 along either side of the opening 20 and at the top edge 18 of the casement. The edges of the opposing pocket lining walls are joined to each other and to the outer casement along the side perimeters. In short, the joined pocket walls 12*a* and 12*b* delineate the pocket 13 having an opening 20. Padding 21 is contained in the interior space 7 so as to provide cushioning between the pocket walls 12*a* and 12*b* and the adjacent casement walls 11*a* and 11*b*. In the embodiments of FIGS. 1–3 the padding material 21 is shown minimally in amount or thickness to emphasize the pocket 13. The actual amount or thickness of padding relative to the size of the pocket may vary depending upon whether the pillow 10 is to be used primarily as a carrying and travel case or as a pillow providing optimal head rest comfort.

FIGS. 1–3 further portray closure means 14 for facilitating the closure of the pocket 13 by bringing the edges of casement walls 11*a* and 11*b* together at the upper perimeter 18 thereby preventing the loss of the contents contained in pocket 13. The closure means 14 may be of any type known in the art so long as the desired results are obtained, namely the secure closure of the opening, optimal comfort, random access to the pocket and security as determined by practice and custom. For example, the closure means 14 may be a VELCRO type hook and loop, zipper or snap closure means and may be located on the casement at the pillow opening or at the upper edge of pocket sidewalls 12*a* and 12*b* as shown in the drawings.

As shown in FIG. 2, there is preferably provided carrying means, such as a strap or a handle (not shown) to facilitate the carrying of the pillow. The strap or handle is preferably attached to the upper portion of the pillow whereby the user may more easily utilize the pillow as a carrier to convey pajamas, a blanket or any other desired sleep over items on a trip. This handle or strap can be of any length so as to be used as a shoulder strap or, in a shorter version, a hand held strap. Furthermore, this handle or strap can be made of any material or fabric possessing sufficient strength to hold the pillow and any contents placed in the pocket. Additionally this handle may be of any suitable length and can be attached at any portion along the upper end of the pocket in a pillow. FIG. 2 further contains a optional graphic depiction 6 on outer surface. While this has noting to do with the functionality of the invention it is illustrative of a depiction that would be pleasing to a young person. While not illustrated, the pillow of the invention can assume any desired shape or configuration. For example the pillow can be contoured in the shape of an animal, plant or inanimate object An opening, extending into the interior of a padded animal that is lined to serve as a pocket may serve the same function. The pocket walls may be attached to the outer fabric covering of the animal body at an opening in the same manner as in the pillow casement of FIGS. 1—3. It must be further understood that the animal shape is also a pillow in that it must contain sufficient padding on either side of the pocket to provide the desired comfort when used as a pillow and to also provide protection to stored and/or carried items. This embodiment may be configured to represent any variety of animals such as the bear, dog, cat, turtle or any other shape so long as the embodiment functions as a pocket in a pillow as herein described. Indeed, this embodiment also may be in the form of imaginary animals such as dragons or aliens. It is envisioned that the formed pillow, regardless of shape contain sufficient padding on either side of the interior pocket so the desired level of comfort is provided when used as a pillow and the desired level of protection to stored and/or carried items be provided.

DETAILED DESCRIPTION OF THE INVENTION

Pursuant to the present invention, a pillow of conventional construction has an outer cover or casement of suitable material defining an interior space. As with a conventional pillow, the interior contains appropriate stuffing or padding held within the cover so it may, if desired, function as a pillow when empty and yet may simultaneous with the storage of items, also function as a suitably comfortable pillow. Unlike other designs, however, the present invention lacks a seam on one edge, thereby providing additional strength and durability and comfort to the pillow. The pillow can be of any desired configuration. However, for purposes of illustration it will be described in terms of a conventional pillow the perimeter of which is defined by opposing sides, an open edge and an edge lacking a seam, i.e. is generally rectangular in shape. Along one edge of the pillow is an opening that functions as an entrance to a pocket extending into the interior of the pillow.

In one preferred embodiment, the pocket is defined by means of opposing lining walls attached to the casement along either side of the opening at the pillow perimeter and attached to each other along opposing side edges. If desired, closure means may be located at the pocket entrance to secure the pocket in a closed position. In one preferred embodiment the closure means facilitates entrance into the pocket at any is selected point of the entrance, while maintaining closed the remaining portions of the closure means. Still further, the closure means should be selected to provide optimum comfort, strength, durability and resistance to weather caused damage.

In another preferred embodiment, the pocket is as previously defined except were closure means may be along three sides of the pocket. In this embodiment, the pillow is only fixedly attached along one perimeter and is operably attached along the remaining perimeters. In this embodiment, the closure means could be opened, providing an elongated pillow. This type of opening can be visualized as the opening of a hanging file from a "V" configuration when each side perimeter is openable attached to the adjacent side but which can be opened up, pushing the two top edges away from each other, to lie flat on a surface, such as a desk or floor. In this embodiment, a pack a pillow according to this embodiment may open to provide a pillow of larger area, perhaps for use by a pet, more than one person or as a ground cover. Suitable closure means for accomplishing this embodiment are inter engaging snaps or perhaps hook and loop type systems such as a VELCRO system. The closure means should allow random access to the pocket through any point along the closure, without requiring that other sections be opened. This freedom and multiple pathway access to the pocket increases convenience and also provides an additional mode to practice this invention.

The pocket is situated in the pillow interior such that the stuffing or padding is positioned between the pocket walls and exterior cover on all sides of the pocket, i.e., the padding generally fills a compartment which is one continuous padding section,

What is claimed is:

1. A combination travel pillow-suit case having an interior storage pocket comprising:

an outer casement of suitable flexible material having casement peripheries comprising an inner-casement surface, an outer-casement surface, a casement right edge defining a casement right edge length including a casement right edge upper portion, having a casement right edge upper portion length and a casement right edge lower portion having a casement right edge lower portion length, a casement left edge defining a casement left edge length including a casement left edge upper portion having a casement left edge upper portion length and a casement left edge lower portion having a casement left edge lower portion length, a casement first top edge and a casement second top edge;

a pocket lining of suitable flexible material with generally the same dimensions as the outer casement having substantially identical peripheries comprising a pocket lining outer surface, a pocket lining inner surface comprising a pocket lining right edge defining a pocket lining right edge length including a pocket lining right edge upper portion, having a pocket lining right edge upper portion length and a pocket lining right edge lower portion having a pocket lining right edge lower portion length, a pocket lining left edge defining a pocket lining left edge length including a pocket lining left edge upper portion having a pocket lining left edge upper portion length and a pocket lining left edge lower portion having a pocket lining left edge lower portion length, a pocket lining first top edge and a pocket lining second top edge;

the outer casement and the pocket lining joined along the peripheries and surrounding and defining a pillow filler compartment;

padding means generally filling the pillow filler compartment and providing padding between the opposing casement surface and the pocket lining surface for comfort as a pillow and for protection of a stored item;

a pocket, adapted for protecting and transporting an item placed therein, defined by attachment of the pocket lining right side lower portion to the pocket lining right side upper portion and the pocket lining left side lower portion to the pocket lining left side upper portion, including a nonjoined portion defining a pocket entrance for access to the interior of the pocket;

a carrying means for transporting the combination travel pillow-suit case attached to the outer casement surface a releasable closure means fixedly attached to the pocket lining inner surface at the pocket entrance for closing the pocket entrance wherein, the closure means has closure sections and is selectively openable at a random section, to the exclusion of other sections.

2. A travel pillow-suit case as in claim 1 wherein the closure means is a hook and loop closure means.

3. A travel pillow-suit case as in claim 1 wherein the padding means is at least 0.25 inches thick.

4. A travel pillow-suit case as in claim 1 wherein the carrying means is at least two separate carrying means.

5. A travel pillow-suit case as in claim 4 wherein one carrying means is removably attached to the casement first top edge.

6. A travel pillow-suit case as in claim 4 wherein one carrying means is removably attached to the casement second top edge.

7. A travel pillow-suit case as in claim 4 wherein one carrying means is fixedly attached to the casement first top edge.

8. A travel pillow-suit case as in claim 4 wherein one carrying means is fixedly attached to the casement second top edge.

9. A travel pillow-suit case as in claim 1 wherein the casement left edge upper portion and the casement left edge lower portion are of substantially the same length.

10. A travel pillow-suit case as in claim 1 wherein the casement right edge upper portion and the casement right edge lower portion are of different lengths.

11. A travel pillow-suit case as in claim 1 wherein the casement peripheries define generally a geometric shape.

12. A travel pillow-suit case as in claim 1 wherein the casement peripheries define generally a non-geometric shape.

13. A travel pillow-suit case as in claim 12 wherein the casement peripheries define generally an animal shape.

14. A travel pillow-suit case as in claim 1 further comprising a first adherence means fixedly attached to the pocket lining inner surface.

15. A travel pillow-suit case as in claim 14 wherein a second pocket comprising a first and a second outer panel of suitable flexible material having substantially identical peripheries where each first and second panel have an outer and an inner surface and where said panels are joined along three of said peripheries and including a non joined portion for access to the interior of said second pocket forming a second pocket opening and where, closure means is attached to said second pocket opening and where a second adherence means is fixedly attached to an outer surface of said second pocket.

16. A travel pillow-suit case as in claim 14 wherein said first adherence means is removably attached to said second adherence means thereby providing a second pocket removably attached to the pocket lining wall.

17. A travel pillow-suit case as in claim 1 further comprising a blanket having an outer periphery when folded of substantially the same as the pocket inner lining periphery.

18. A travel pillow-suit case as in claim 17 wherein the blanket and the outer casement are of substantially the same material.

19. A travel pillow-suit case as in claim 1 wherein the outer casement material is waterproof.

* * * * *